United States Patent [19]

Matsuda

[11] Patent Number: 4,962,580

[45] Date of Patent: Oct. 16, 1990

[54] METHOD OF AND APPARATUS FOR MANUFACTURING SLIDE FASTENER STRINGERS

[75] Inventor: Yasuhiko Matsuda, Toyama, Japan

[73] Assignee: Yoshida Kogyo K.K., Tokyo, Japan

[21] Appl. No.: 480,892

[22] Filed: Feb. 16, 1990

[30] Foreign Application Priority Data

Feb. 27, 1989 [JP] Japan ..... 1-45780

[51] Int. Cl.[5] ..... B21D 53/52

[52] U.S. Cl. ..... 29/410; 29/769; 29/809; 221/123; 221/264

[58] Field of Search ..... 29/408, 410, 766, 769, 29/809; 221/123, 264, 273

[56] References Cited

U.S. PATENT DOCUMENTS

| | | | |
|---|---|---|---|
| 2,003,146 | 5/1935 | Gutberlett . | |
| 2,066,359 | 1/1937 | Nägele | 29/769 |
| 2,227,461 | 1/1941 | Morin et al. . | |
| 2,245,335 | 6/1941 | Frey | 29/408 |
| 2,262,193 | 11/1941 | Morin et al. . | |
| 3,447,229 | 6/1969 | Clark | 29/809 |
| 3,541,666 | 11/1970 | Van Amburg | 29/766 |
| 3,939,547 | 2/1976 | Bernier et al. | 29/408 |
| 4,063,347 | 12/1977 | Woodman, Jr. | 29/809 |

FOREIGN PATENT DOCUMENTS

| | | | |
|---|---|---|---|
| 866106 | 6/1941 | France . | |
| 14479 | 2/1978 | Japan | 221/123 |
| 200046 | 12/1938 | Switzerland . | |
| 1309014 | 3/1973 | United Kingdom . | |

*Primary Examiner*—P. W. Echols

*Attorney, Agent, or Firm*—Hill, Van Santen, Steadman & Simpson

[57] ABSTRACT

A method and apparatus for the manufacture of slide fastener carrying a discrete formation of differently colored elements in selected orders. Method and apparatus are disclosed for feeding a plurality of colored elements selectively one at a time in a vertical direction and transferring one such element horizontally to a predetermined position for gravity fall onto a stringer tape.

6 Claims, 8 Drawing Sheets

METHOD OF AND APPARATUS FOR MANUFACTURING SLIDE FASTENER STRINGERS

BACKGROUND OF THE INVENTION

1. Field of the Invention

This invention relates to a method of and an apparatus for manufacturing slide fastener stringers having a discrete formation of selectively colored coupling elements 2. Prior Art There are known a variety of slide fasteners having rows of discrete coupling elements made of a metallic material such as gold, silver, copper and the like which presents its intrinsic monochromatic hue. However, to the best knowledge of the present inventors, there has been proposed no such slide fastener which carries metallic or resinous coupling elements of different colors arranged in an alternate distribution along a longitudinal edge of the stringer tape. Attempts have been made to produce slide fastener stringers having coupling elements of such various colors which would be attractively compatible with garment articles of versatile designs and styles to which the slide fastener is applied. One such attempt was to supply a mix of differently colored coupling elements from a parts feeder or hopper to an element applying station where the elements are applied to fastener stringer tapes, in which instance a photoelectric sensor was used to sort out a group of elements of the same color. This operation was not only time-consuming but also often hindered by the presence of irregularities in the hue of each individual element and the influence of ambient light.

SUMMARY OF THE INVENTION

It is therefore a primary object of the present invention to provide a method and apparatus which will enable the production of slide fasteners having colored coupling elements arranged in selective orders and at predetermined intervals with high efficiency and simplicity of operation.

This and other objects and features of the invention will appear clear from the following detailed description taken in connection with the accompanying drawings.

According to the invention, there is provided a method which comprises the steps of receiving and feeding a plurality of differently colored coupling elements selectively one at a time from respective vertically disposed chutes, transferring the one coupling element horizontally to a predetermined position for gravity fall onto the longitudinal edge of the tape and clamping the one element in place, followed by receiving and feeding a next selected one of the colored elements from the corresponding one of the chutes.

This method is carried into practice by an apparatus comprising a plurality of vertically disposed chutes for feeding respective groups of colored coupling elements, a horizontally disposed base, a slide supported on the base for horizontal reciprocating movement and having a pocket selectively registrable with one of the chutes, a transfer chute integral with the base and having an opening registrable with the pocket for transferring the coupling elements one at a time onto the tape edge, a controlled drive means comprising cam members and a cam follower and adapted to effect horizontal reciprocating movement of the slide, and a program-control drive device adapted to drive the cam members selectively.

DETAILED DESCRIPTION OF THE INVENTION

Figure 1:
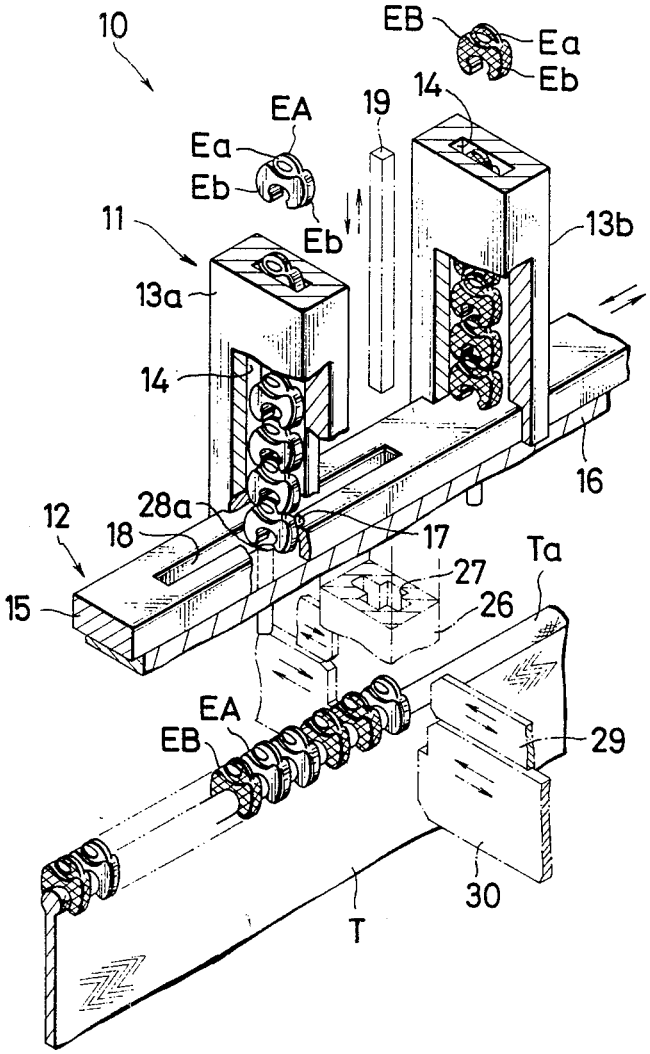
FIG. 1 is a perspective view of an apparatus for manufacturing slide fastener stringers embodying the invention.

Referring now to the drawings and FIG. 1 in particular, there is shown an apparatus 10 embodying the invention which comprises a feed unit 11 and a transfer unit 12. The feed unit 11 includes a pair of vertically disposed feed chutes 13*a* and 13*b* each having an elongate vertical opening 14 dimensioned to accommodate a number of vertically aligned coupling elements E supplied from a parts feeder or hopper located up above (not shown). The elements E are made of a metallic or other pliable material and each have a coupling head portion Ea and a pair of bifurcated leg portions Eb. They are let fall by gravity in succession with the leg portions Eb of one element E directed downwardly in confrontation with the head portion Ea of a preceding element E. A series of elements E of one color are contained in the first chute 13*a* and another group of elements of a different color in the second chute 13*b*.

The transfer unit 12 comprises a slide 15 supported on a base 16 for horizontal reciprocating movement thereon. A pocket 17 is formed centrally in the slide 15 for receiving coupling elements E of a given size one at a time from either of the chutes 13*a* and 13*b*.

An elongate longitudinal slot 18 is formed in the slide 15 for receiving therethrough a vertically movable positioning bar 19 later described.

A compression spring 20 is connected to the rear end of the slide 15 for normally urging the latter toward a drive cam 21 later described.

Figure 2:
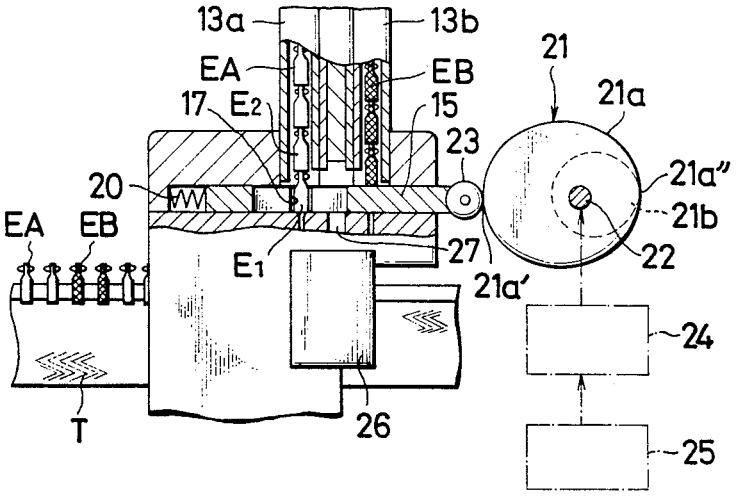
FIG. 2 is a diagrammatic, partly sectional, view of a major portion of the apparatus of FIG. 1.

As better shown in FIG. 2, the bottom end of each of the chutes 13*a*, 13*b* is spaced from the upper surface of the base 16 by a distance substantially equal to the height of the element leg Eb such that the slide 15 can move a leading or lowermost element $E_1$ forwardly without interference with a next ensuing element $E_2$.

Horizontal reciprocating movement of the slide 15 is effected by a controlled drive means comprising a large-diameter cam disc 21*a* and a small-diameter cam disc 21*b* both mounted coaxially but eccentrically on a drive shaft 22 and a cam follower 23 in the form of a roller rotatably connected to the rear end of the slide 15 and selectively engageable with the cam discs 21*a* and 21*b*. There are provided as many cam discs 21*a* and 21*b* as are the feed chutes 13*a* and 13*b*. The drive shaft 22 extends horizontally in alignment with the cam follower 23 and is driven by a suitable drive 24 which selectively provides rotation and axial movement of the shaft 22 such that the cam follower 23 selectively comes into peripheral engagement with either of the cam discs 21*a* and 21*b*.

Figure 7A:
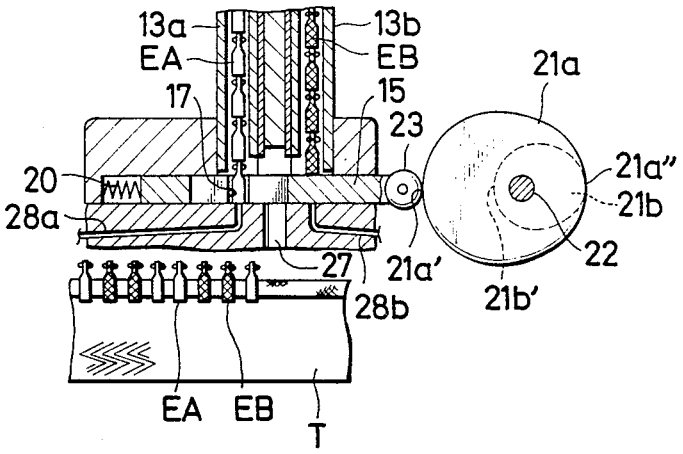
FIGS. 7*a* through 9*b* inclusive are diagrammatic views utilized to explain the operation of the apparatus according to the invention.
Figure 7B:
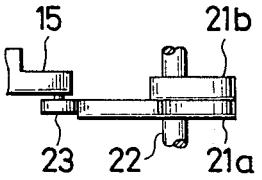
Figure 8A:
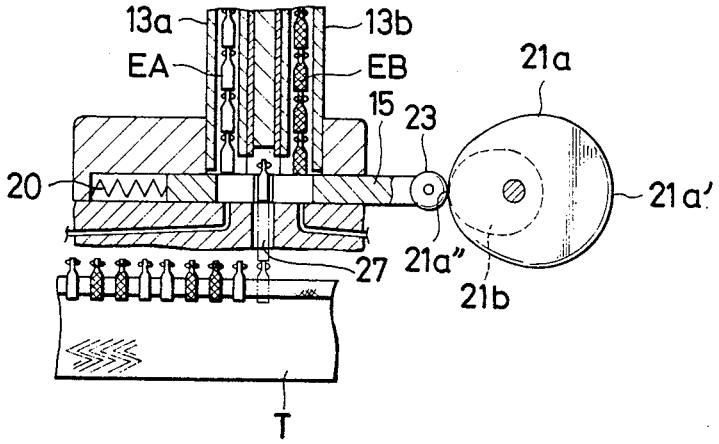
Figure 8B:
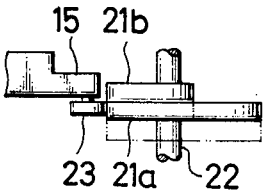

The large-diameter cam disc 21*a* is eccentrically mounted on the shaft 22 so as to provide diammetrically opposed first peripheral surface point 21*a'* and second peripheral surface point 21*a''* selectively engageable with the cam follower 23. The first peripheral surface point 21' defines with the cam follower 23 a first position in which the pocket 17 registers with the first feed chute 13*a* to receive the element $E_1$ therefrom as shown in FIGS. 7*a* and 7*b* . The second peripheral surface point 21*a''* defines with the cam follower 23 a second position in which the pocket 17 registers with a criss-cross opening 27 later described to transfer the element $E_1$ onto the stringer tape T as shown in FIGS. 8*a* and 8*b*.

Figure 9A:
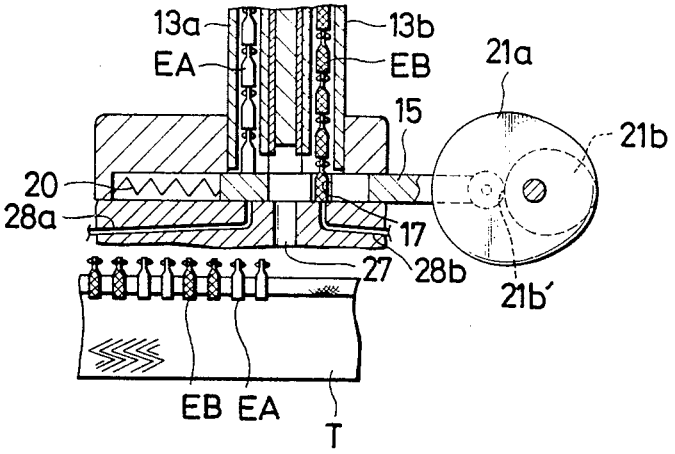
Figure 9B:
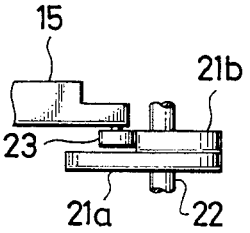

The small-diameter cam disc 21*b* is eccentrically mounted on the shaft 22 so as to provide a third peripheral surface point 21*b* ' nearest the shaft 22 which is engageable with the cam follower 23 to define a third position in which the pocket 17 registers with the second chute 13*b* to receive the element $E_1$ therefrom as shown in FIGS. 9*a* and 9*b*.

Figure 3:
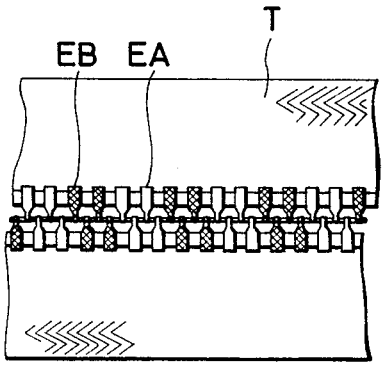
FIG. 3 is a fragmentary plan view of a fastener stringer having one selected formation of colored coupling elements.
Figure 4:
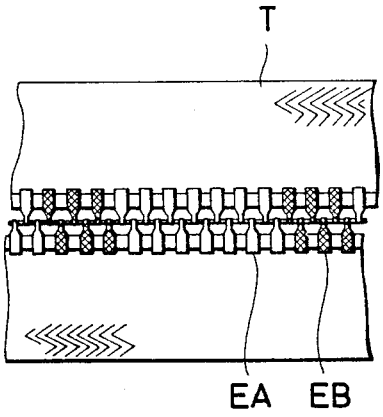
FIG. 4 is a view similar to FIG. 3 but showing a fastener stringer having another formation of colored coupling elements.

Designated at 25 is a computerized control device operatively associated with the drive 24 and program-controlled so as to provide a variety of patterns for the distribution of coupling elements E on a pair of stringer tapes T such as shown in FIGS. 3 and 4. Two successive coupling elements EA from the chute 13*a* alternate with two successive elements EB from the chute 13*b* as shown in FIG. 3, and three successive elements EB alternate with a group of seven elements EA as shown in FIG. 4. Various other patterns are provided as desired by program-control of the computer device 25 which in turn controls the drive 24 to provide selective rotary and axial movement of the shaft 22 to implement any particular program in a manner well known in the art.

Designated at 26 is an element receiving and transferring chute integral with and extending vertically downwardly from the base 16 and having a criss-cross opening 27 dimensioned to receive an element E and registrable with the pocket 17 in the slide 15.

Designated at 28*a* and 28*b* are elongate slits formed in the base 16 in registry with the openings 14, 14 of the chutes 13*a* and 13*b* , respectively, for providing suction air from a suction device (not shown) whereby a leading element $E_1$ is attracted into the pocket 17 in the slide 15.

Referring now to FIGS. 7*a* through 9*b* inclusive, there is illustrated a sequence of operation of the apparatus 10 in which two differently colored coupling elements EA and EB are fed and transferred selectively onto the stringer tape T. As the first cam disc 21*a* rotates in peripheral engagement at its first peripheral point 21*a* ' with the cam follower 23, the slide 15 is retracted or moved toward the left as viewed in the drawings against the tension of the spring 20 as far back as the pocket 17 comes into registry with the first chute 13*a* , whereupon the leading or lowermost element $E_1$ of the group EA is let fall by gravity into the pocket 17, as shown in FIGS. 7*a* and 7*b*.

Further rotation of the cam disc 21*a* substantially through 180°, until its second peripheral point 21*a''* (which is diammetrically opposed to the first point 21*a'*) arrives at the cam follower 23, allows the slide 15 to move forward toward the right as viewed in the drawings under the influence of the tension of the spring 20 as far forth as the pocket 17 registers with the transfer chute 26 to let the element $E_1$ fall through the opening 27 with the leg portions Eb of the element EA mounted astride over a longitudinal beaded edge Ta of the stringer tape T as shown in FIGS. 8*a* and 8*b*.

The falling of the element $E_1$ of the group EA through the transfer chute 26 is followed by another 180° rotation of the cam 21*a* which is immediately followed by axial movement of the drive shaft 22 to release the first cam disc 21*a* from the cam follower 23 and cause the slide 15 through the action of the spring 20 to move further forward until the cam follower 23 engages the second cam disc 21*b* at the third peripheral point 21*b* ' thereof, whereupon the pocket 17 registers with the second chute 13*b* and receives the leading element $E_1$ of the group EB as shown in FIGS. 9*a* and 9*b*. The cam 21*b* is then rotated through 180° so as to retract the slide 15 to the position of FIG. 8*a* in which the pocket 17 is brought into registry with the transfer chute 26 to drop the element EB therethrough onto the tape T in the manner already described.

Figure 5:
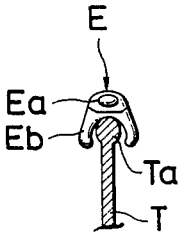
FIG. 5 is a diagrammatic elevational view of a coupling element mounted astride a tape edge.
Figure 6:
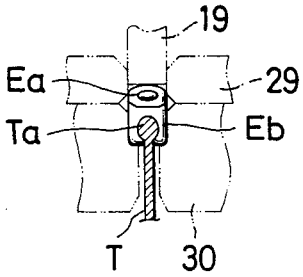
FIG. 6 is a diagrammatic elevational view of the coupling element shown clamped onto the tape.

The elements EA and EB thus mounted with their leg portions Eb astride the tape edge Ta as better shown in FIG. 5 are held in place by the positioning bar 19 which has descended through the slot 18 and by a pair of retaining bars 29, 29 and clamped firmly to the tape T by a pair of punches 30, 30 as diagrammatically shown in FIG. 6. This is followed by inching movement of the tape for a distance substantially corresponding to one element E to wait for a succeeding one of the elements E of the group EA or EB.

Figure 10:
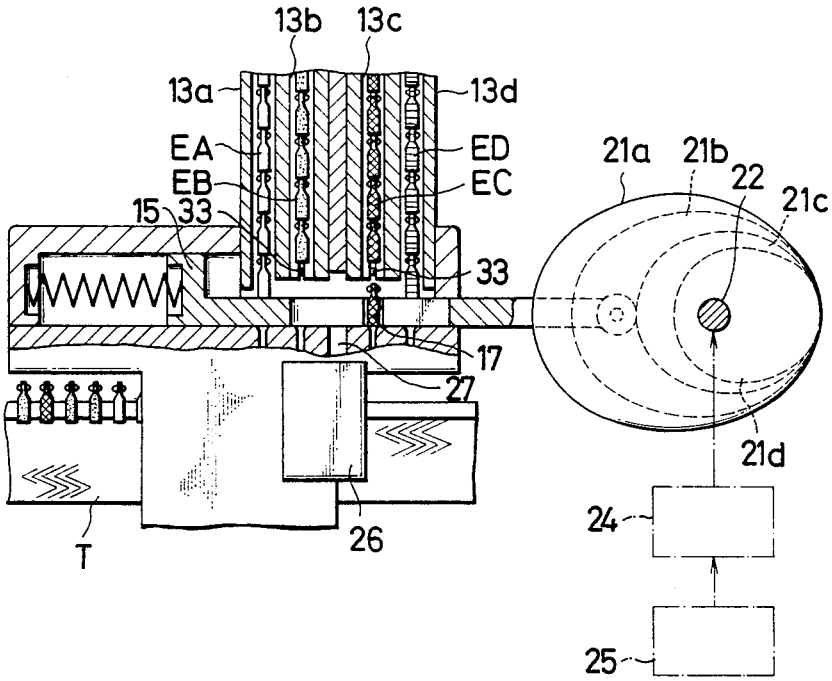
FIG. 10 is a diagrammatic, partly sectional, view of a modified form of apparatus embodying the invention.
Figure 12:
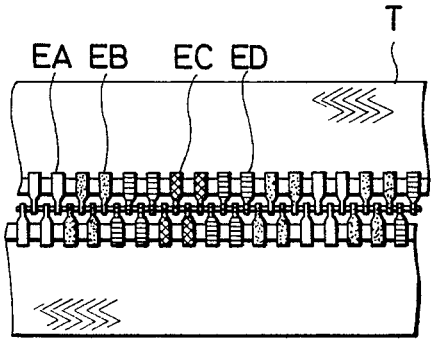
FIG. 12 is a view similar to FIGS. 3 and 4 but showing a fastener stringer having still another formation of coupling elements.

FIG. 10 shows a modified form of apparatus 10 which includes a total of four serially arranged feed chutes 13*a* , 13*b* , 13*c* and 13*d* and hence a total of four cam discs 21*a* , 21*b* , 21*c* and 21*d* progressively reduced in diameter in this order and mounted coaxially but eccentrically on the drive shaft 22, the arrangement being that a total of four differently colored coupling elements EA, EB, EC and ED can be applied to the stringer tape T in the order shown in FIG. 12 and substantially in a manner similar to and apparent from the operating procedure already described in connection with the apparatus 10 shown in FIGS. 1 through 9*b*.

The patterns of distribution of the elements E are symmetrical as shown in FIGS. 3, 4 and 12, but may be made asymmetrical or otherwise varied at will depending upon the programs which may be computerized in the control device 25.

Figure 11:
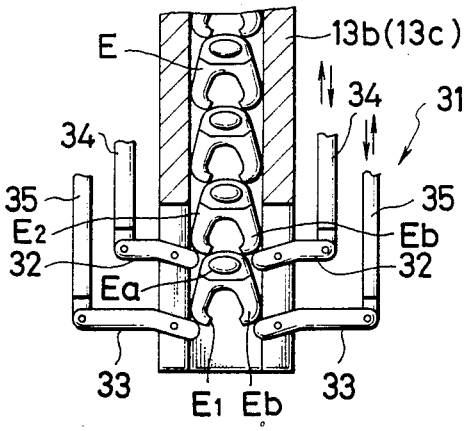
FIG. 11 is a fragmentary elevational view of a stopper mechanism incorporated in the apparatus of the invention.

FIG. 11 shows a stop mechanism 31 which is useful in preventing spontaneous gravity fall of the elements E particularly in the case where a plurality of feed chutes are installed as shown in FIG. 10. The stop mechanism 31, which may be effectively located at the bottom of each of the inner chutes 13*b* and 13*c*, comprises two pairs 32 and 33 of first and second stop arms which are pivotally connected to respective links 34 and 35. The first pair of stop arms 32 and the second pair 33 are spaced vertically apart from each other by a distance such that the first pair arrest the leg portions Eb of the leading element $E_1$ and the second pair arrest the leg portion Eb of the next ensuing element $E_2$ as their respective links 34 and 35 are moved downwardly as by air cylinders not shown to hold the two pairs of stop arms 32 and 33 in closed disposition as shown in FIG. 11. The stop mechanism 31 is arranged to operate so that the first pair 32 opens to let fall the leading element $E_1$ while the second pair 33 still engages and holds the ensuing element $E_2$. The first pair 32 then closes to receive the ensuing element $E_2$ upon release from the second pair 33. This cycle of operation is repeated so that the elements E in a vertical row are successively transferred one at a time so as to prevent spontaneous, inadvertent fall of the elements E onto the slide 15.

Obviously, various modifications and variations of the present invention are possible in the light of the above teaching. It is therefore to be understood that within the scope of the appended claims the invention may be practiced otherwise than as specifically described For instance, there may be used a vertically reciprocating plate cam having as many cam surfaces as are the feed chute, or a crank mechanism, in place of the presently illustrated cam discs.

What is claimed is:

1. In the manufacture of a slide fastener carrying a discrete formation of a plurality of groups of colored coupling elements in selected orders and at predetermined intervals along a longitudinal edge of a stringer tape, a method which comprises the steps of receiving and feeding a plurality of differently colored coupling elements selectively one at a time from respective vertically disposed chutes, transferring said one coupling element horizontally to a predetermined position for gravity fall onto the longitudinal edge of the tape and clamping said one element in place, followed by receiving and feeding a next selected one of said colored elements from the corresponding one of said chutes.

2. An apparatus for the manufacture of slide fasteners having a plurality of groups of differently colored coupling elements in selected orders and at predetermined intervals along a longitudinal edge of a stringer tape, the apparatus comprising a plurality of vertically disposed chutes for feeding respective groups of colored coupling elements, a horizontally disposed base, a slide supported on said base for horizontal reciprocating movement and having a pocket selectively registrable with one of said chutes, a transfer chute integral with said base and having an opening registrable with said pocket for transferring said coupling elements one at a time onto the tape edge, a controlled drive means comprising cam members and a cam follower and adapted to effect horizontal reciprocating movement of said slide, and a program-control drive device adapted to drive said cam members selectively.

3. An apparatus according to claim 2, wherein said cam members each are in the form of discs mounted coaxially but eccentrically on a drive shaft and rotatable therewith between a first position in which said pocket registers with one of said chutes and a second position in which said pocket registers with said opening.

4. An apparatus according to claim 2 further including a biasing means adapted to urge said slide normally toward said controlled drive means.

5. An apparatus according to claim 2 wherein said cam discs are reduced in diameter progressively.

6. An apparatus according to claim 2 further including a stop mechanism located at the bottom of selected ones of said chutes and adapted to releasably arrest and hold said coupling elements from spontaneous gravity fall onto said slide.

* * * * *